US010343439B2

(12) United States Patent
Matsumoto

(10) Patent No.: US 10,343,439 B2
(45) Date of Patent: Jul. 9, 2019

(54) CLOTH MEDIUM TO BE RECORDED, RECORDED CLOTH MEDIUM, AND CLOTH MEDIUM CARTRIDGE

(71) Applicant: Brother Kogyo Kabushiki Kaisha, Nagoya-shi, Aichi-ken (JP)

(72) Inventor: Haruki Matsumoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/461,742

(22) Filed: Mar. 17, 2017

(65) Prior Publication Data

US 2017/0190201 A1 Jul. 6, 2017

Related U.S. Application Data

(63) Continuation-in-part of application No. PCT/JP2015/075014, filed on Sep. 2, 2015.

(30) Foreign Application Priority Data

Nov. 28, 2014 (JP) ..... 2014-242562

(51) Int. Cl.
*B41M 5/382* (2006.01)
*B41J 2/325* (2006.01)
(Continued)

(52) U.S. Cl.
CPC ..... *B41M 5/382* (2013.01); *B41J 2/325* (2013.01); *B41J 3/4078* (2013.01); *B41J 15/044* (2013.01);
(Continued)

(58) Field of Classification Search
None
See application file for complete search history.

(56) References Cited

U.S. PATENT DOCUMENTS

| | | | |
|---|---|---|---|
| 6,132,119 | A | 10/2000 | Nakajima et al. |
| 9,126,448 | B2 | 9/2015 | Matsumoto |
| 2014/0086660 | A1 | 3/2014 | Matsumoto |

FOREIGN PATENT DOCUMENTS

| | | | |
|---|---|---|---|
| JP | H06-33992 | U | 5/1994 |
| JP | H06-248537 | A | 9/1994 |

(Continued)

OTHER PUBLICATIONS http://textilelearner.blogspot.com/2011/03/description-of-textile-finishing_1796.html (page visited on Jun. 8, 2018, but first available online 2011) (Year: 2011).*

(Continued)

*Primary Examiner* — Shawn McKinnon
(74) *Attorney, Agent, or Firm* — Banner & Witcoff, Ltd.

(57) ABSTRACT

The disclosure discloses an elongated cloth medium to be recorded made with a satin weave that ranges from six-harness satin to ten-harness satin by using a warp in a medium longitudinal direction and a weft in a direction orthogonal to the medium longitudinal direction. The cloth medium includes one surface and another surface. The warp has a weaving density that ranges from 300 [yarns/inch] to 540 [yarns/inch]. The weft has a weaving density that ranges from 80 [yarns/inch] to 540 [yarns/inch]. The one surface is a surface with the warp more exposed than the weft in accordance with the satin weave. The cloth medium further includes on the one surface a print-receiving surface that calendering is executed.

7 Claims, 11 Drawing Sheets

(51) Int. Cl.

| | |
|---|---|
| ***D03D 1/00*** | (2006.01) |
| ***B41J 3/407*** | (2006.01) |
| ***B41J 15/04*** | (2006.01) |
| ***D03D 13/00*** | (2006.01) |
| ***D03D 15/00*** | (2006.01) |
| ***D06P 5/24*** | (2006.01) |
| ***D06P 5/20*** | (2006.01) |
| *D06P 1/52* | (2006.01) |

(52) U.S. Cl.

CPC ..... *D03D 1/00* (2013.01); *D03D 13/004* (2013.01); *D03D 13/008* (2013.01); *D03D 15/00* (2013.01); *D06P 5/009* (2013.01); *D06P 5/2066* (2013.01); *D06P 1/525* (2013.01); *D06P 1/5221* (2013.01); *D06P 1/5235* (2013.01); *D06P 1/5271* (2013.01); *D06P 1/5285* (2013.01); *D10B 2401/041* (2013.01); *D10B 2401/14* (2013.01); *D10B 2403/0114* (2013.01)

(56) References Cited

FOREIGN PATENT DOCUMENTS

| | | | |
|---|---|---|---|
| JP | H06-340183 | A | 12/1994 |
| JP | H07-26439 | A | 1/1995 |
| JP | H07-232483 | A | 9/1995 |
| JP | H07-278996 | A | 10/1995 |
| JP | H11-296121 | A | 10/1999 |
| JP | 2001-207358 | A | 8/2001 |
| JP | 2004-358936 | A | 12/2004 |
| JP | 2008-214849 | A | 9/2008 |
| JP | 2011-127253 | A | 6/2011 |
| JP | 2014-069329 | A | 4/2014 |
| JP | 2014-069332 | A | 4/2014 |
| WO | 2011/152059 | A1 | 12/2011 |

OTHER PUBLICATIONS

Machine translation of JPH0726439, Morigaki (Year: 1995).*
Machine translation of JP2008214849, Kawabata et al. (Year: 2008).*
Machine translation of JP201469332, Matsumoto (Year: 2014).*
Machine translation of JP2001207358, Kitamura (Year: 2001).*
Jan. 11, 2018—(JP) Decision of Refusal—App 2014-242562.
Jun. 8, 2017—(WO) IPRP—App PCT/JP2015/075014.
Nov. 17, 2015—International Search Report—Intl App PCT/JP2015/075014.
Jul. 7, 2017—(JP) Notification of Reasons for Refusal—App 2014-242562.
Jun. 8, 2018—(EP) Extended Search Report13 App 15864159.7.

* cited by examiner

[FIG. 1]
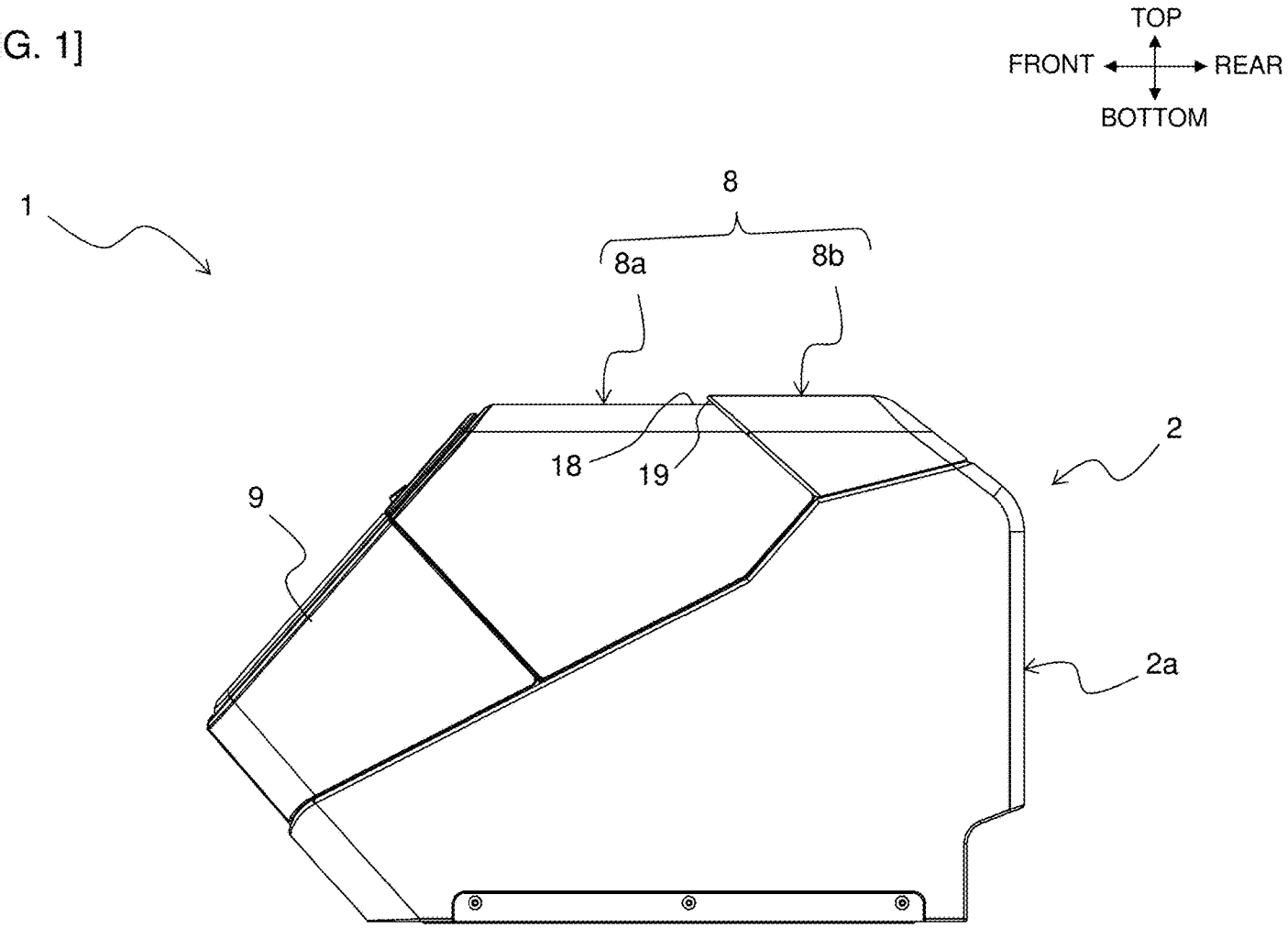

[FIG. 2]
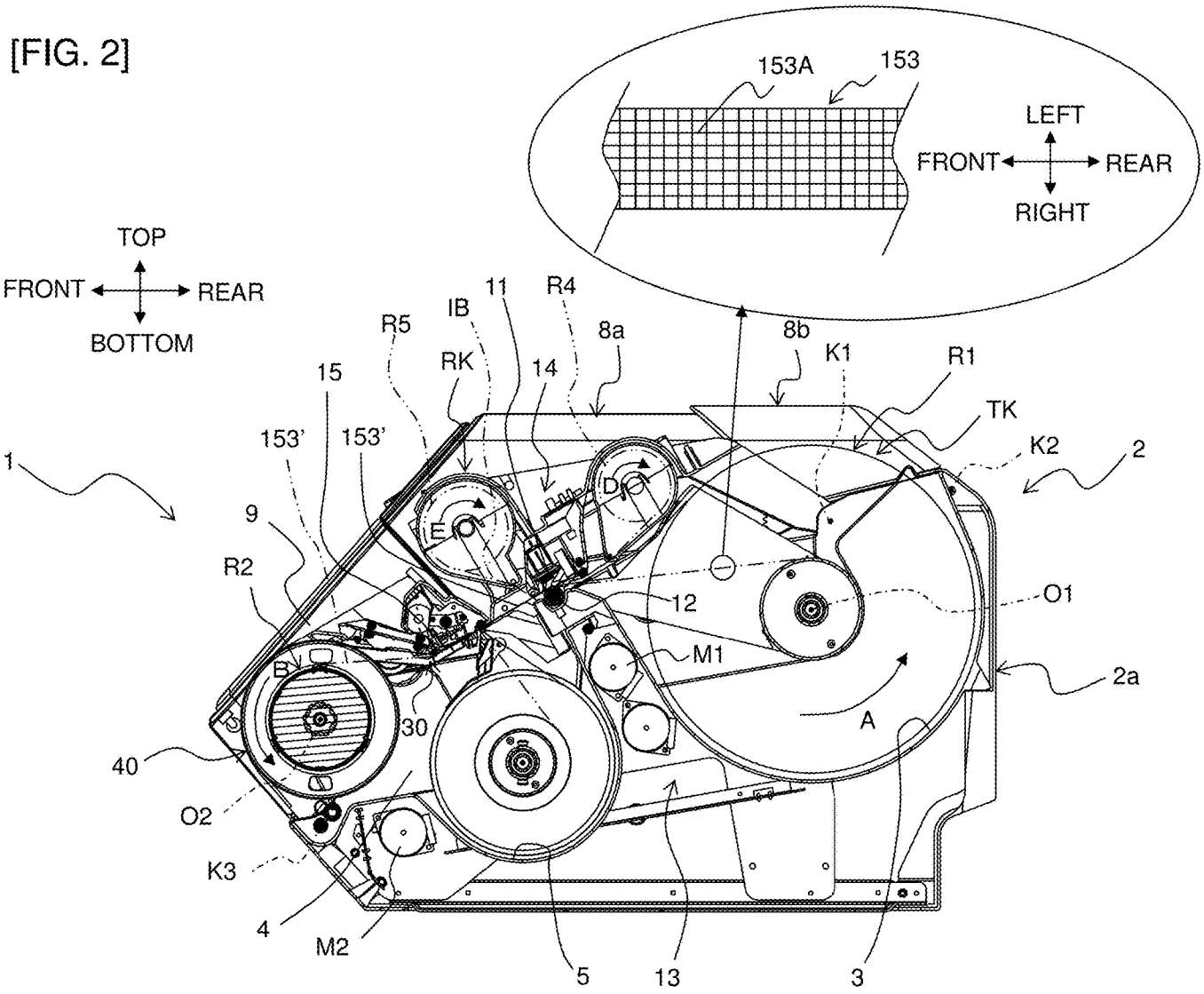

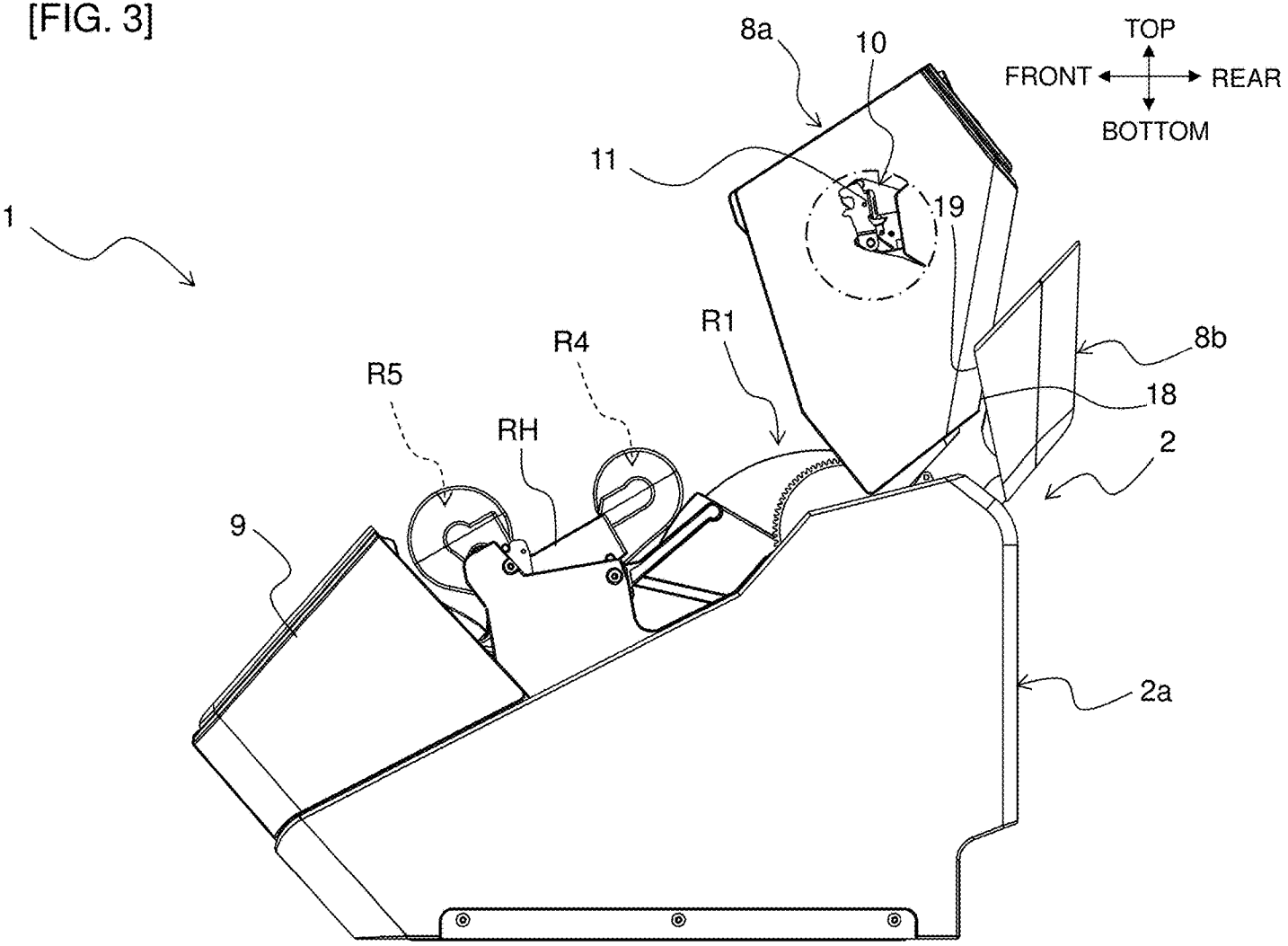
[FIG. 3]

[FIG. 4]
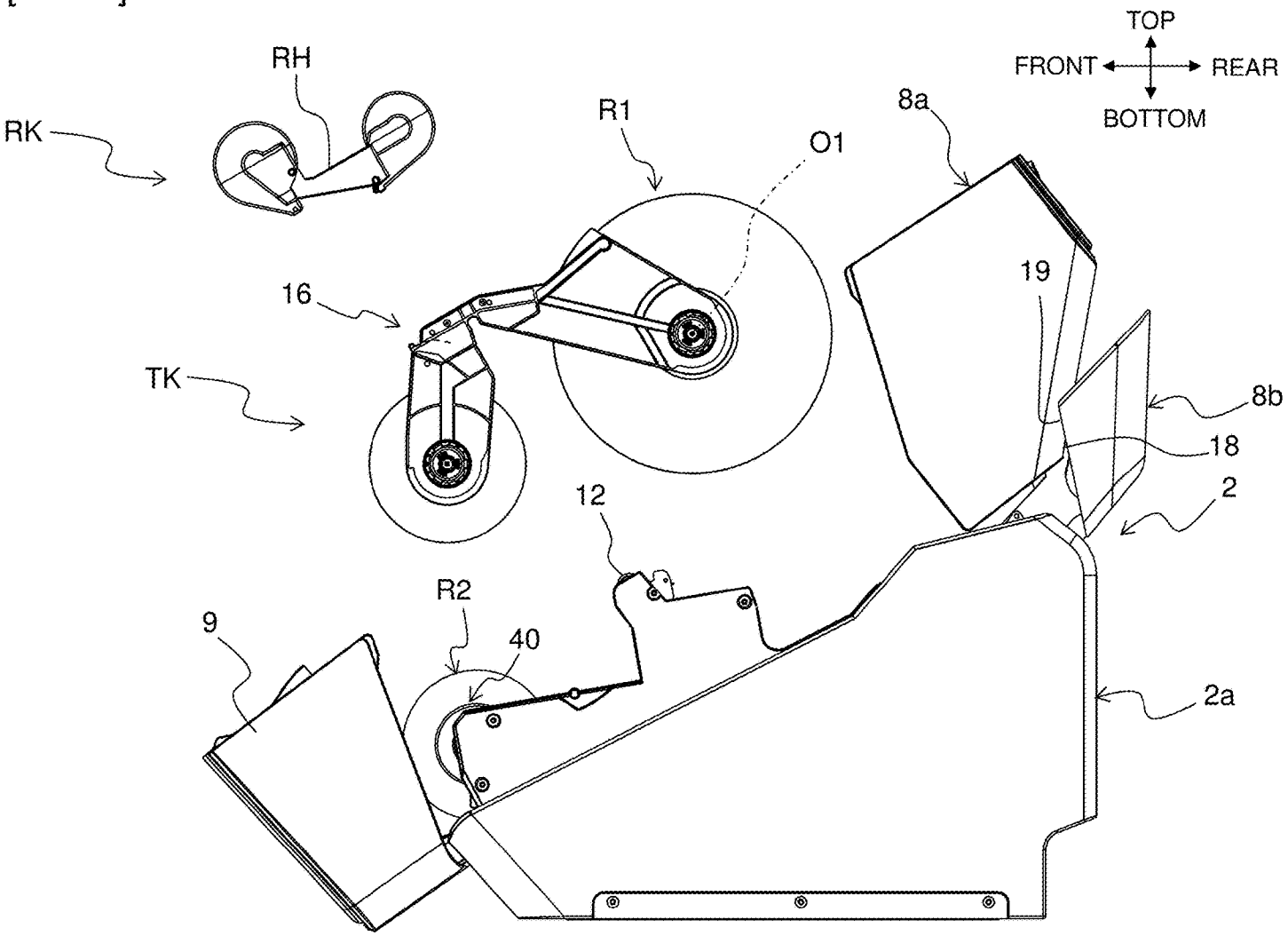

[FIG. 5]
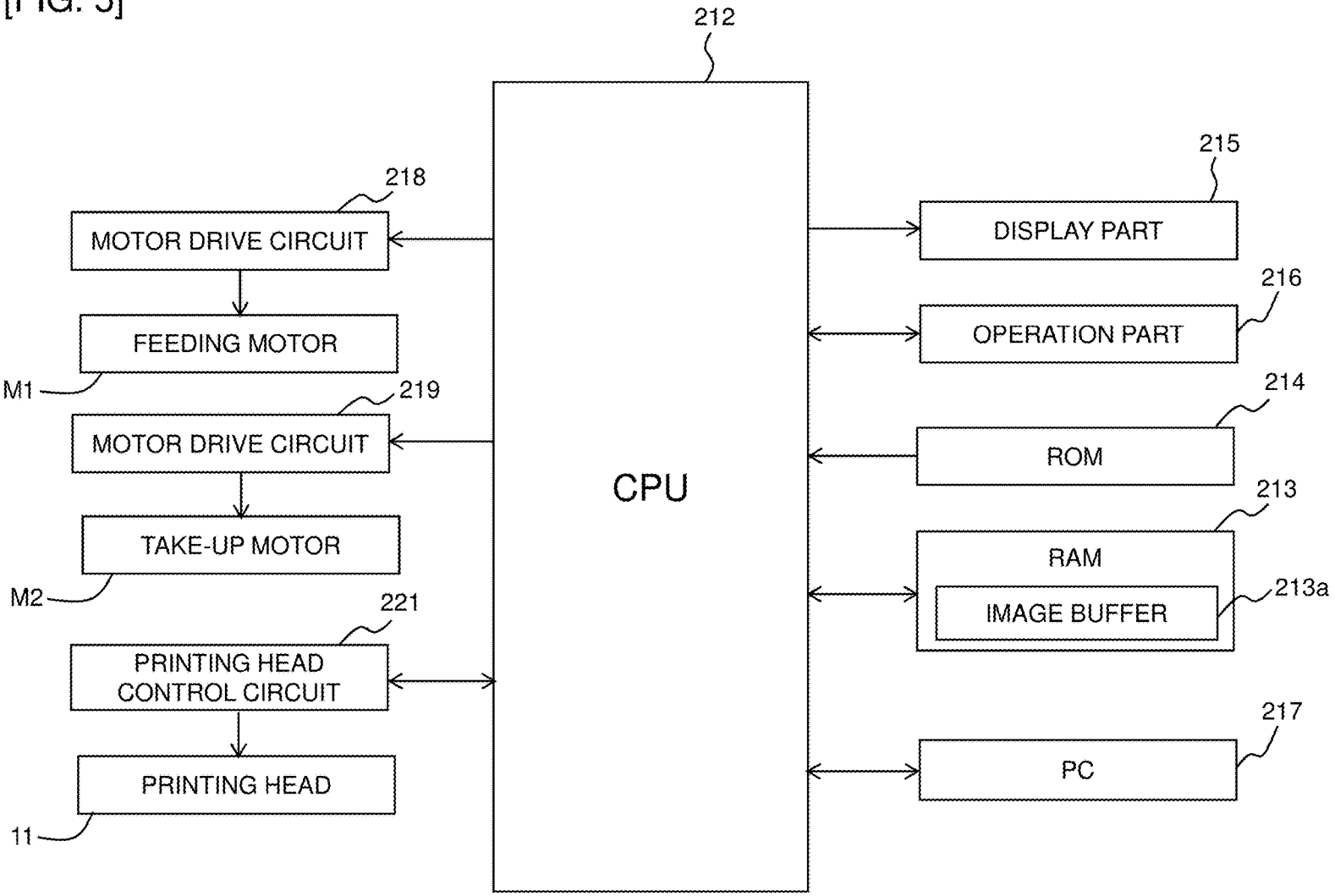

[FIG. 6A]
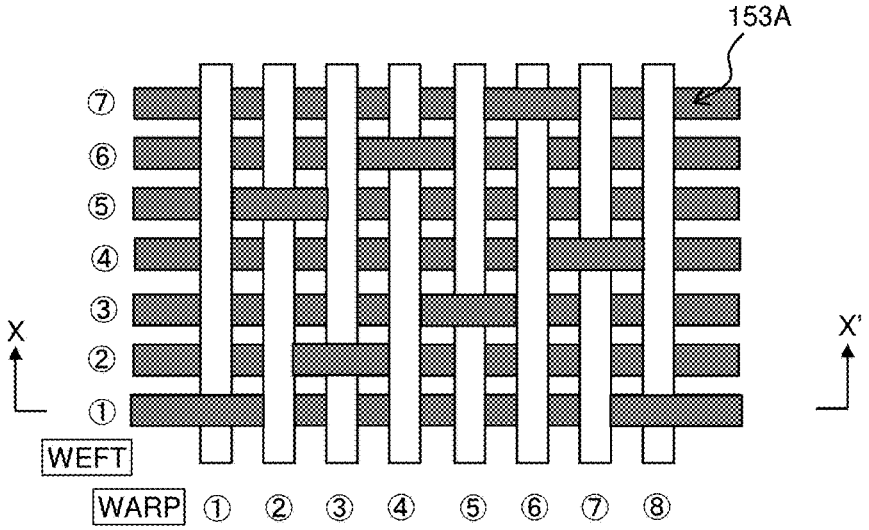
[FIG. 6B]
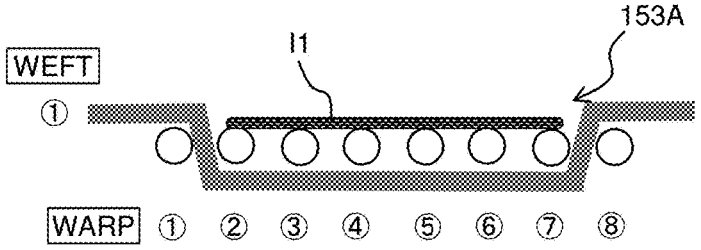
[FIG. 6C]
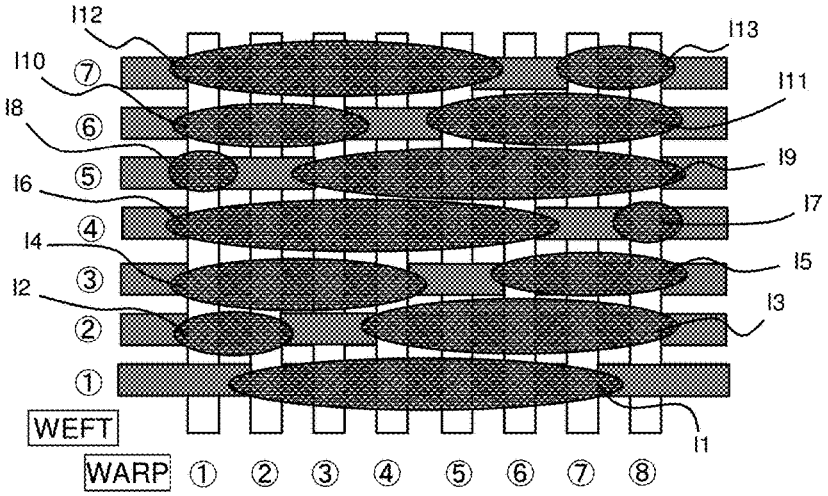

[FIG. 7A]
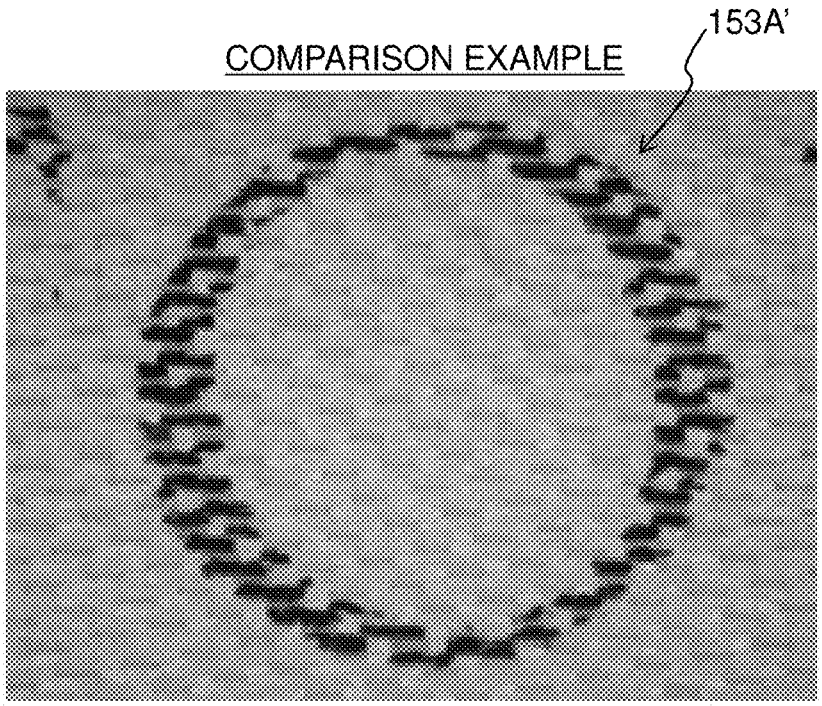
[FIG. 7B]
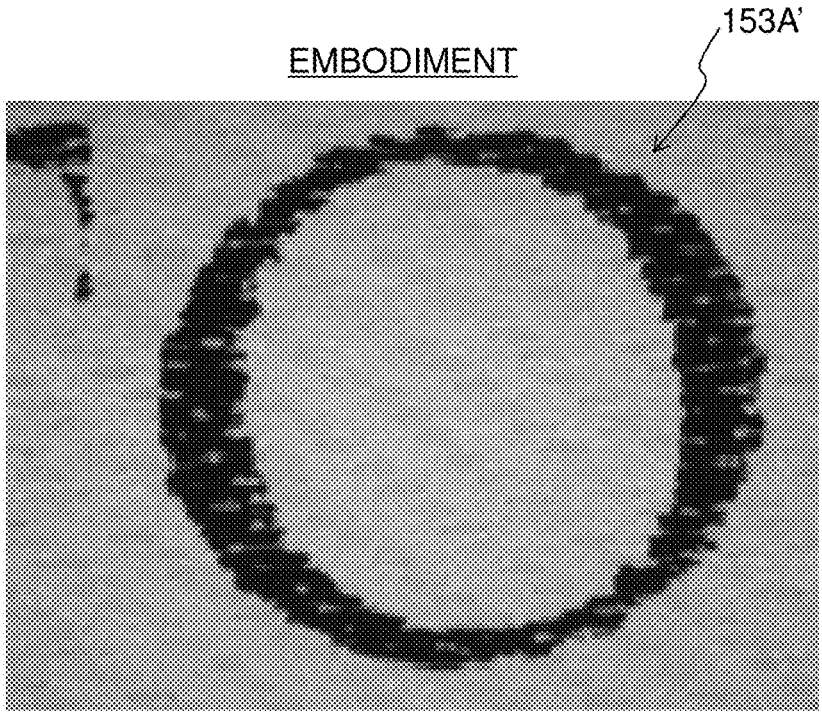

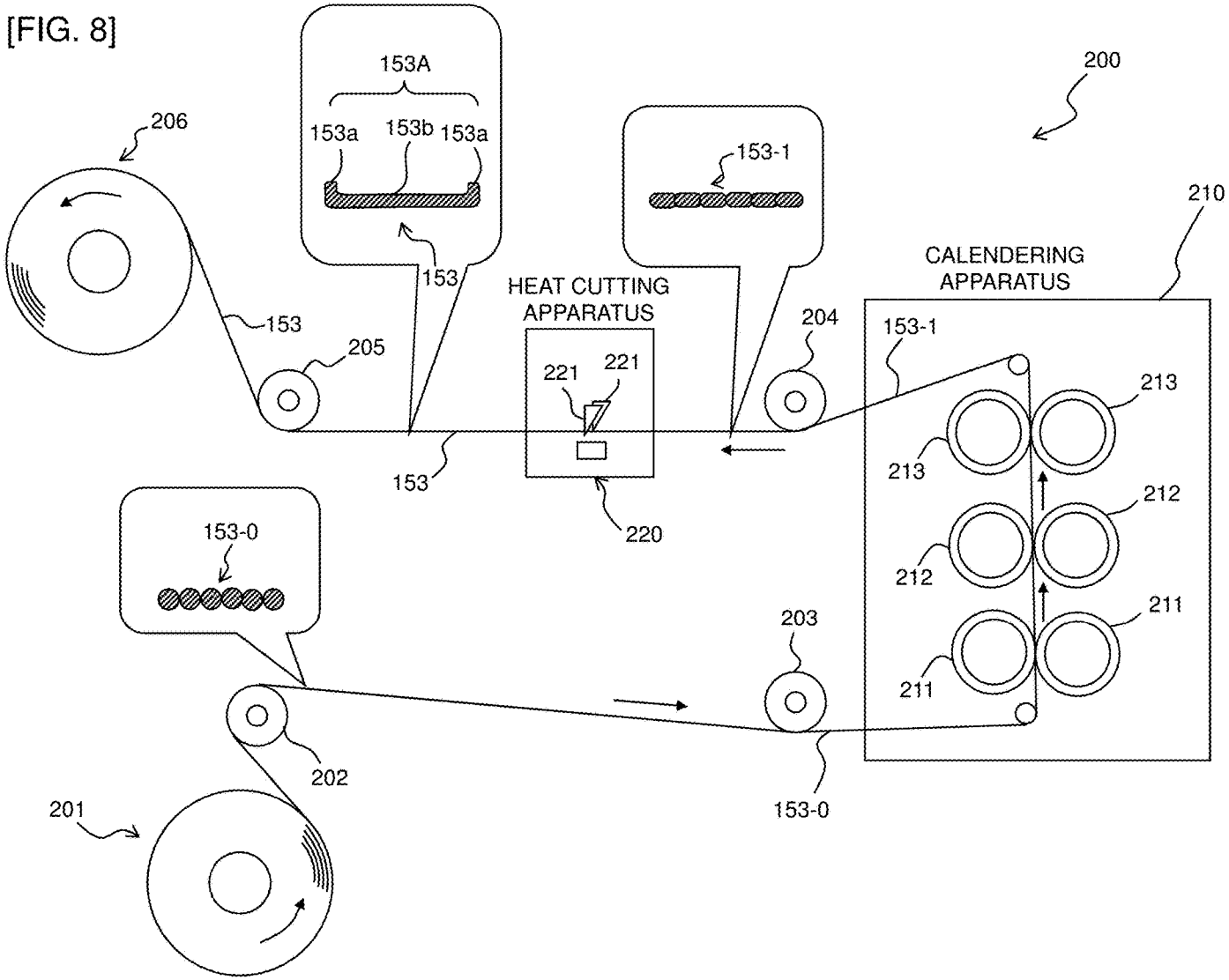
[FIG. 8]

[FIG. 9A]
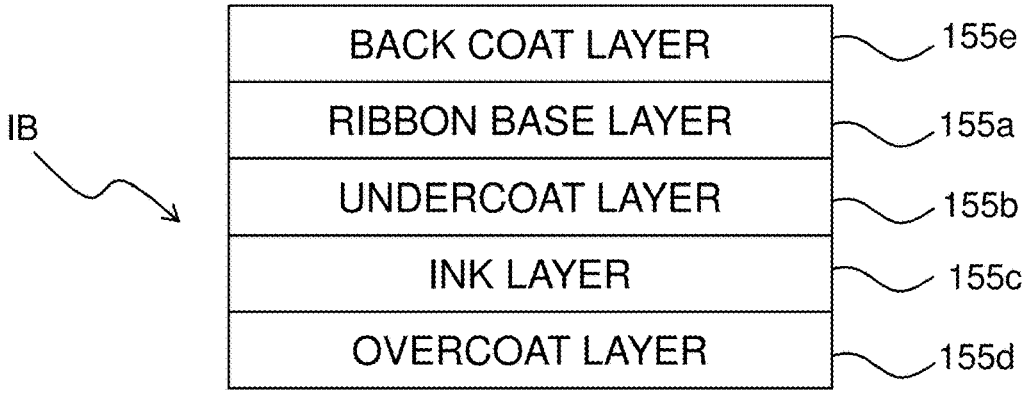
[FIG. 9B]
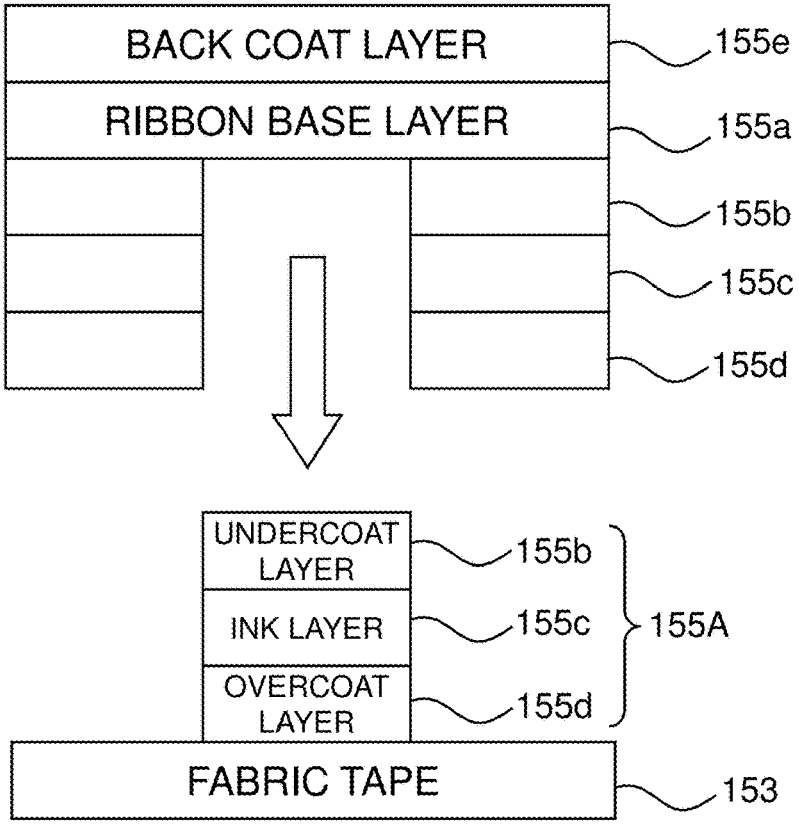

[FIG. 10A]
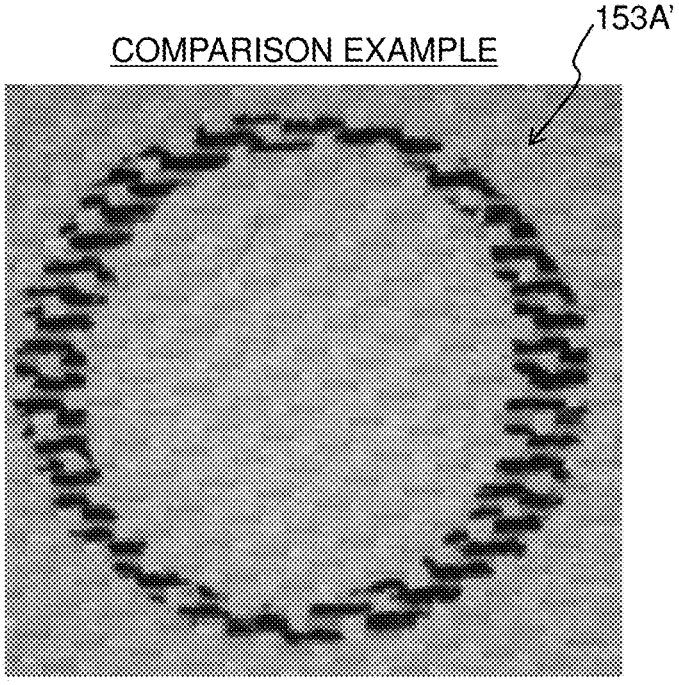
[FIG. 10B]
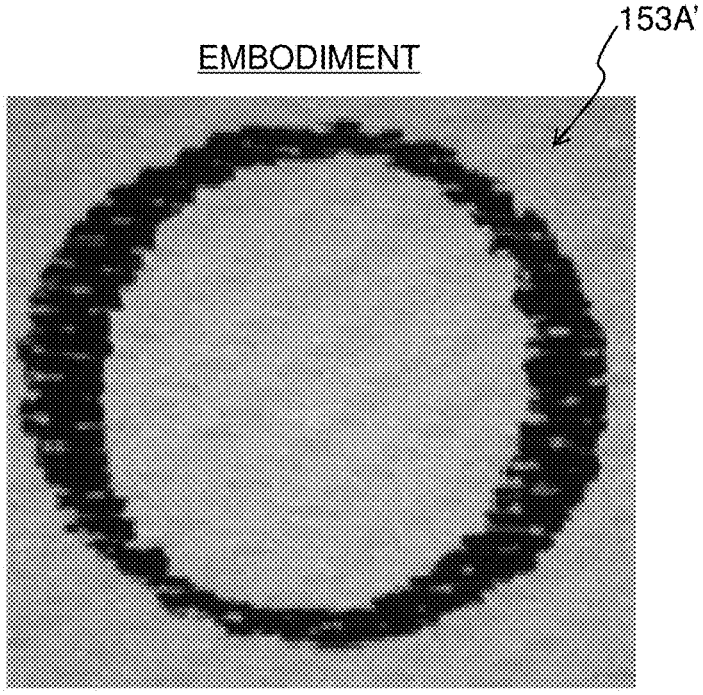

[FIG. 11A]
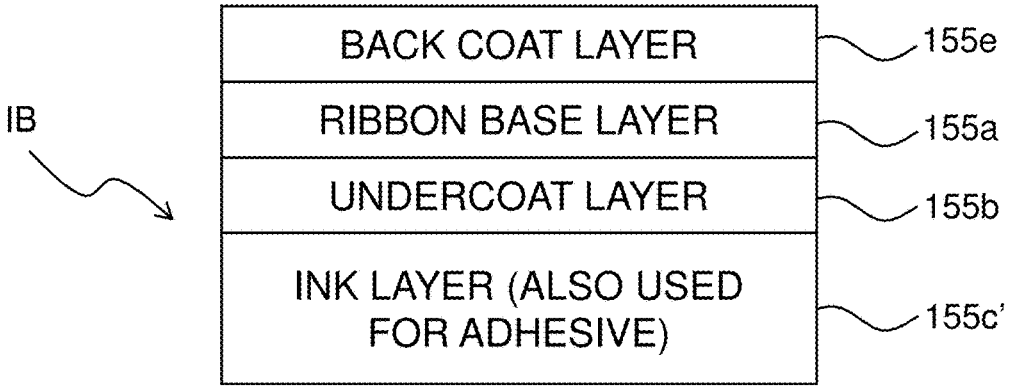
[FIG. 11B]
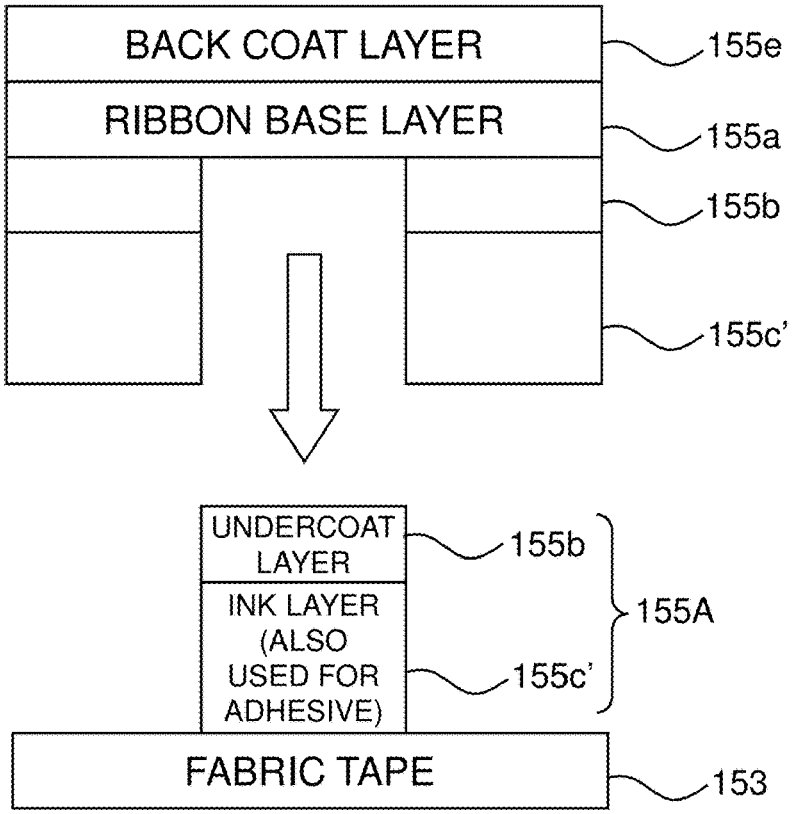

CLOTH MEDIUM TO BE RECORDED, RECORDED CLOTH MEDIUM, AND CLOTH MEDIUM CARTRIDGE

CROSS-REFERENCE TO RELATED APPLICATION

This is a CIP application of PCT/JP2015/075014, filed Sep. 2, 2015, which was not published under PCT article 21(2) in English.

BACKGROUND

Field

The present disclosure relates to a cloth medium to be recorded for forming a print, a recorded cloth medium having a formed print, and a cloth medium cartridge comprising a cloth medium to be recorded.

Description of the Related Art

A technique of performing a print on a cloth medium to be recorded (cloth tape) by transfer of ink of an ink ribbon (dye-containing heat transfer printing ribbon) is already known.

Generally, a cloth medium includes woven warp and weft and consequently has unevenness due to weaving on a surface. Since the significant unevenness impedes smooth print formation by the heat transfer printing of the ink as described above, some measures must be taken to ensure a high print quality. Particularly when a high-speed print is performed, a sufficient time cannot be taken for melting and transferring of the ink, so that sufficient measures are required. In the prior art, it cannot be said that sufficient considerations are given to ensuring such an improvement in print quality.

SUMMARY

It is an object of the present disclosure to provide a cloth medium to be recorded, a recorded cloth medium, and a cloth medium cartridge.

In order to achieve the above-mentioned object, according to the aspect of the present application, there is provided an elongated cloth medium to be recorded made with a satin weave that ranges from six-harness satin to ten-harness satin by using a warp in a medium longitudinal direction and a weft in a direction orthogonal to the medium longitudinal direction, the cloth medium comprising one surface and another surface, the warp having a weaving density that ranges from 300 [yarns/inch] to 540 [yarns/inch], the weft having a weaving density that ranges from 80 [yarns/inch] to 540 [yarns/inch], the one surface being a surface with the warp more exposed than the weft in accordance with the satin weave, and the cloth medium further comprising on the one surface a print-receiving surface that calendering is executed.

The cloth medium to be recorded of the first disclosure comprises a print-receiving surface. To this print-receiving surface, ink of an ink ribbon receiving heat from a thermal head is transferred to form a print. In this case, the unevenness on the print-receiving surface can be reduced in this cloth medium to be recorded by using a satin weave increasing the warp exposed on a medium surface and by using as the print-receiving surface the medium surface (one surface) with the exposure of the warp increased as compared to the exposure of the weft. Particularly, by setting the weaving density of the warp to 300 [yarns/inch] or more, the number of warp yarns can be increased to reliably increase the exposure. Particularly, by using a six-or-more-harness satin, the intersection points of the warp and the weft can be reduced to reliably increase the weaving density of the warp. By setting the weaving density of the warp to 540 [yarns/inch] or less, the warp can be restrained from becoming too thin and resulting in a reduction in durability or causing misalignment in the satin weave. At the time of manufacturing of a cloth medium using a weaving machine, the weaving machine must finely divide and move the warp upward and downward in accordance with the harnesses number of the satin and, in the first disclosure, a ten-or-less-harness satin is used so as to restrain the weaving from becoming too complicated and to enable reliable manufacturing by the weaving machine.

A calendering applying heat and pressure with rollers can be applied to the print-receiving surface to give a gloss to the surface of the print-receiving surface. Since the print-receiving surface having less unevenness and more warp exposure along with the gloss can be achieved as described above, a printing quality can be improved when a print is formed by transferring of the ink. Particularly, when a high-speed print is performed, a quality improvement effect is large.

BRIEF DESCRIPTION OF THE DRAWINGS

FIG. 1 is a right side view of an exterior appearance of a tape printer related to an embodiment of the present disclosure.

FIG. 2 is a side cross-sectional view of an internal structure of the tape printer.

FIG. 3 is a right side view of the exterior appearance of the tape printer with a first openable cover and a second openable cover opened.

FIG. 4 is an exploded side view of the tape printer with the first openable cover and the second openable cover opened and a tape cartridge and a ribbon cartridge removed.

FIG. 5 is a functional block diagram of a control system of the tape printer FIG. 6A is a conceptual top view of a portion of a print-receiving surface of a cloth tape.

FIG. 6B is a conceptual cross-sectional view taken along a cross section X-X' of FIG. 6A.

FIG. 6C is an explanatory view of an adhesion behavior of ink droplets adhering to the cloth tape.

FIG. 7A is an appearance view of a cloth tape showing a print formation result according to a comparison example.

FIG. 7B is an appearance view of a cloth tape showing a print formation result according to the embodiment of the present disclosure.

FIG. 8 is an explanatory diagram of manufacturing equipment of the cloth tape.

FIG. 9A is an explanatory diagram of a laminated structure of an ink ribbon.

FIG. 9B is a transfer behavior of the ink ribbon to a cloth tape.

FIG. 10A is an appearance view of a cloth tape showing a print formation result according to another comparison example.

FIG. 10B is an appearance view of a cloth tape showing a print formation result according to the embodiment of the present disclosure.

FIG. 11A is an explanatory diagram of a laminated structure of an ink ribbon.

FIG. 11B is a transfer behavior to a cloth tape in a modification example in which an ink layer additionally has an adhesive function.

DETAILED DESCRIPTION OF THE PREFERRED EMBODIMENTS

An embodiment of the present disclosure will now be described with reference to the drawings. If "front," "rear," "left," "right," "top," and "bottom" are noted in the drawings, "front (forward)," "rear (backward)," "left (leftward)," "right (rightward)," "top (upper)," and "bottom (lower)" in the description indicate the noted directions.

<General Configuration of Tape Printer>

A general configuration of a printer related to this embodiment will be described with reference to FIGS. 1 to 4.

In FIGS. 1 to 4, a tape printer 1 of this embodiment has a housing 2 constituting an outer contour of the device, a rear openable part 8, and a front openable cover 9.

The housing 2 comprises a housing main body 2*a*, a first storage part 3 disposed on the rear side of the housing main body 2*a*, and a second storage part 4 and a third storage part 5 disposed on the front side of the housing main body 2*a*.

The rear openable part 8 is connected to an upper portion on the rear side of the housing main body 2*a* in an openable manner The rear openable part 8 can pivot to open and close the top of the first storage part 3. The rear openable part 8 includes a first openable cover 8*a* and a second openable cover 8*b*.

The first openable cover 8*a* can pivot around a predetermined pivot axis K1 provided on an upper portion on the rear side of the housing main body 2*a* to open and close the top on the front side of the first storage part 3. A head holder 10 is provided inside the first openable cover 8*a* (see FIG. 3). The first openable cover 8*a* can pivot around the above described rotation axis K1 to move a printing head 11 (thermal head) included in the head holder 10 relatively away from/close to a feeding roller 12 provided on the housing main body 2*a*.

The second openable cover 8*b* is provided on the rear side relative to the above described first openable cover 8*a* and can pivot around a predetermined pivot axis K2 provided on an upper end portion on the rear side of the housing main body 2*a* to open and close the top on the rear side of the first storage part 3 separately from opening/closing of the above described first openable cover 8*a*.

When both the first openable cover 8*a* and the second openable cover 8*b* are in the closing state, an outer circumferential portion 18 of the first openable cover 8*a* and an edge portion 19 of the second openable cover 8*b* are brought into substantial contact with each other to substantially entirely cover the top of the first storage part 3.

The front openable cover 9 is connected to an upper portion on the front side of the housing main body 2*a* in an openable manner The front openable cover 9 can pivot around a predetermined pivot axis K3 provided on an upper end portion on the front side of the housing main body 2*a* to open and close the top of the second storage part 4. Specifically, the front openable cover 9 can pivot from a closing position covering the top of the second storage part 4 (the state of FIGS. 1 to 3) to an opening position exposing the top of the second storage part 4 (the state of FIG. 4).

In this configuration, a tape cartridge TK is detachably mounted on the housing main body 2*a* at a first predetermined position 13 under the front openable cover 9 in the closing state. The tape cartridge TK comprises a first roll R1 wound and formed around an axis O1 and a coupling arm 16 (see FIG. 4).

The first roll R1 is supported on the rear side of the tape cartridge TK by the coupling arm 16 and is freely rotatable when the tape cartridge TK is mounted on the housing main body 2*a*. In the first roll R1, an elongated cloth tape 153 to be fed out and consumed is wound around the axis O1 of the left-right direction in advance. In the figures of this embodiment, the above described cloth tape 153 included as the above described first roll R1 is eliminated as appropriate (for simplicity of illustration) to show only a substantially circular roll flange part provided to sandwich both sides in the width direction of the cloth tape 153. In this case, for convenience, the roll flange part is simply shown with a reference numeral "R1" added thereto.

In this configuration, when the tape cartridge TK is mounted, the first roll R1 is received from above and stored in the first storage part 3 with the axis O1 of winding of the cloth tape 153 defined in the left-right direction. While being stored in the first storage part 3 (while the tape cartridge TK is mounted), the first roll R1 rotates in a predetermined rotation direction (direction A of FIG. 2) in the first storage part 3 to feed out the cloth tape 153.

As shown in an enlarged view in FIG. 2, the above described cloth tape 153 has one surface (an upper surface in FIG. 2) that is a print-receiving surface 153A with a substantially smooth finish (described later in detail) on which a print is formed by the above described printing head 11. Therefore, onto the print-receiving surface 153A of the cloth tape 153, the tape printer 1 performs a desired printing corresponding to printing data from a PC 217 (see FIG. 5 described later) acting as an operation terminal by heat transfer printing of ink of an ink ribbon IB using the above described printing head 11. This will be described later.

The above described feeding roller 12 is provided on the upper middle side of the first storage part 3 and the third storage part 5 in the housing main body 2*a*. The feeding roller 12 is driven via a gear mechanism (not shown) by a feeding motor M1 provided on the housing main body 2*a*, and thereby feeds the cloth tape 153 fed out from the first roll R1 stored in the first storage part 3, in a tape posture with a tape width direction defined as the left-right direction.

The above described head holder 10 disposed on the first openable cover 8*a* comprises the above described printing head 11. The printing head 11 is arranged on the head holder 10 at a position facing the top of the feeding roller 12 in the first openable cover 8*a* in the closing state, so as to sandwich and support the cloth tape 153 fed by the feeding roller 12 in cooperation with the feeding roller 12. Therefore, if the first openable cover 8*a* is in the closing state, the printing head 11 and the feeding roller 12 are arranged to face each other in the top-bottom direction. On the print-receiving surface 153A of the cloth tape 153 sandwiched with the feeding roller 12, the printing head 11 forms a desired print by using the ink ribbon IB of a ribbon cartridge RK described later, thereby turning the tape into a printed cloth tape 153'.

The ribbon cartridge RK is detachably mounted on a second predetermined position 14 under the first openable cover 8*a* and above the tape cartridge TK in the closing state of the housing main body 2*a*. The ribbon cartridge RK comprises a housing RH (see FIGS. 3 and 4), a ribbon supply roll R4, and a ribbon take-up roll R5.

The ribbon supply roll R4 is freely rotatably supported by the housing RH on the rear side of the ribbon cartridge RK and has the ink ribbon IB (see FIG. 9 described later) wound around a predetermined axis. The ribbon supply roll R4 rotates in a predetermined rotation direction (direction D of FIG. 2) in a mounted state of the ribbon cartridge RK so as to feed out the ink ribbon IB for performing print formation by the printing head 11.

The ribbon take-up roll R5 is freely rotatably supported by the housing RH on the front side of the ribbon cartridge RK and rotates in a predetermined rotation direction (direction E of FIG. 2) in a mounted state of the ribbon cartridge RK so as to take up the used ink ribbon IB after the print formation.

A ribbon take-up roller not shown is included on the downstream side of the printing head 11 along the tape transport direction in the first openable cover 8*a*. The ribbon take-up roller guides the used ink ribbon IB to the ribbon take-up roll R5.

The ink ribbon IB fed out from the ribbon supply roll R4 is disposed closer to the printing head 11 on the cloth tape 153 sandwiched between the printing head 11 and the feeding roller 12 and comes into contact with the bottom of the printing head 11. After a portion of layers of the ink ribbon IB (described in detail later) is heated by the printing head 11 and transferred to the print-receiving surface 153A of the cloth tape 153 to perform the print formation, the used ink ribbon IB is guided by the ribbon take-up roller and taken up by the ribbon take-up roll R5.

The printed cloth tape 153' after print is wound around the outer circumferential side of a take-up mechanism 40 so that a second roll R2 is formed. In particular, the above described take-up mechanism 40 for sequentially winding the printed cloth tape 153' is received in the second storage part 4 from above and stored with an axis O2 of winding of the printed cloth tape 153' defined in the left-right direction such that the mechanism is rotatably supported around the axis O2. While being stored in the second storage part 4, the take-up mechanism 40 is driven via the gear mechanism by a take-up motor M2 provided on the housing main body 2*a* to rotate in a predetermined rotation direction (direction B of FIG. 2) in the second storage part 4, thereby taking up and piling the printed cloth tape 153'. As a result, the printed cloth tape 153' is sequentially wound around the outer circumferential side of the take-up mechanism 40 so that the above described second roll R2 is formed. In the figures of this embodiment, the above described printed cloth tape 153' included in the above described second roll R2 is eliminated as appropriate (for simplicity of illustration) to show only a substantially circular roll flange part provided to sandwich both sides in the width direction of the printed cloth tape 153'. In this case, the roll flange part is simply shown with a reference numeral "R2" added thereto.

<General Operation of Tape Printer>

A general operation of the tape printer 1 will be described.

When the tape cartridge TK is mounted on the first predetermined position 13, the above described first roll R1 located on the rear side of the tape cartridge TK is stored in the first storage part 3, and a portion on the front side of the tape cartridge TK is stored in the third storage part 5. The take-up mechanism 40 for forming the second roll R2 is stored in the second storage part 4.

In this state, when the feeding roller 12 is driven, the cloth tape 153 is fed out by the rotation of the first roll R1 stored in the third storage part 3 and is transported toward the front side. On the print-receiving surface 153A of the transported cloth tape 153, the printing head 11 forms a desired print to turn the tape into the printed cloth tape 153'. The printed cloth tape 153' is further transported toward the front side and introduced into the second storage part 4 and is wound around the outer circumferential side of the take-up mechanism 40 in the second storage part 4 to form the second roll R2. In this state, the printed cloth tape 153' is cut by a cutter mechanism 30 provided on the front openable cover 9 on the rear side relative to the second roll R2, i.e., on the upstream side of the second roll R2 along the tape transport direction. As a result, a user (an operator) can cut the printed cloth tape 153' gradually wound around the printed tape roll R2 at desired timing and take out the second roll R2 from the second storage part 4 after the cutting.

It is noted that a chute 15 may be disposed for switching the transport path of the above described printed cloth tape 153' between the side toward the second roll R2 and the side toward a discharging exit (not shown). In particular, by switching the tape path through a switching operation of the chute 15 with a switching lever (not shown), the printed cloth tape 153' may directly be discharged (without taking up the printed cloth tape 153' with print in the second storage part 4) to the outside of the housing 2 from the discharging exit (not shown) provided on the housing 2 on the second openable cover 8*b* side, for example.

<Control System>

A control system of the tape printer 1 will be described. In FIG. 5, the tape printer 1 comprises a CPU 212. The CPU 212 is connected to a RAM 213, a ROM 214, a display part 215, and an operation part 216. The CPU 212 executes a signal process in accordance with a program stored in advance in the ROM 214 while using a temporary storage function of the RAM 213, thereby generally controlling the tape printer 1. The CPU 212 is also connected to a motor drive circuit 218 carrying out drive control of the above described feeding motor M1 driving the above described feeding roller 12, a motor drive circuit 219 carrying out drive control of the above described take-up motor M2 driving the above described second roll R2, and a printing head control circuit 221 carrying out energization control of heat generation elements of the above described printing head 11.

The RAM 213 comprises an image buffer 213*a* in which printing data in an image data format received from the PC 217 (or generated in accordance with an operation of the operation part 216) is developed and stored as dot pattern data for printing on the cloth tape 153. An appropriate control program stored in the ROM 214 causes the CPU 212 to feed out the cloth tape 153 by the feeding roller 12 and perform printing corresponding to the print data onto the above described print-receiving surface 153A by the printing head 11 via the printing head control circuit 221 in accordance with the above described printing data stored in the image buffer 213*a*. In this embodiment, under the control of the CPU 212, the feeding roller 12 and the printing head 11 are coordinated and controlled in synchronization with each other by a known technique such that the print speed on the cloth tape 153 is 100 [mm/sec] or more to 200 [mm/sec] or less.

<Feature of Embodiment>

In the above configuration, as described above, the tape printer 1 performs the desired printing corresponding to the above-described printing data on the printing-receiving surface 153A of the cloth tape 153 by the heat transfer printing of the ink of the ink ribbon IB using the above described printing head 11. The feature of this embodiment is in the configuration of the cloth tape 153 and the ink ribbon IB for preventing inconvenience that may be caused by an uneven shape of the above described cloth tape 153 at the time of the above described printing so as to ensure a high print quality. The details will hereinafter be described in order.

<Unevenness of Cloth Tape>

A cloth medium like the above described cloth tape 153 generally includes woven warp (extending in the tape longitudinal direction) and weft (extending in the tape width direction) and consequently has unevenness due to weaving on a surface. The significant unevenness impedes smooth print formation by the heat transfer printing using the ink ribbon IB described above. Therefore, some measures must be taken to ensure a high print quality. Particularly when a high-speed print is performed, a sufficient time cannot be taken for melting and transferring of the ink of the ink ribbon IB, so that sufficient measures are required.

<Satin Weave>

As a result of uniquely conducted studies, the present inventors found out that the unevenness on the print-receiving surface 153A can be reduced by forming the cloth tape 153 with a satin weave increasing the warp exposed on the surface and by using as the above described print-receiving surface 153A the surface (medium surface) on the side with the exposure of the warp increased as compared to the exposure of the weft between one surface on one side in the thickness direction and the other surface on the other side in the thickness direction of the cloth tape 153. FIGS. 6A and 6B show conceptual diagrams of the details of the above described satin weave of the cloth tape 153A in this embodiment. FIG. 6A is a conceptual top view of a portion of the print-receiving surface 153A, and FIG. 6B is a conceptual cross-sectional view taken along a cross section X-X' of FIG. 6A.

As shown in FIGS. 6A and 6B, the cloth tape 153 of this embodiment is formed with the satin weave of so-called seven-harness satin. On the above described print-receiving surface 153A, for example, a region shown in FIG. 6A has a weave configuration in which eight warp yarns (1)-(8) and seven weft yarns (1)-(7) cross each other.

In this example, the warp yarn (1) is woven into the back side (the side opposite to the print-receiving surface 153A. the same applies hereinafter) at the position of crossing with the weft yarn (1) and is woven to be exposed on the front side (the print-receiving surface 153A side. the same applies hereinafter) at the positions of crossing with the remaining wefts (2)-(7). Similarly, the warp yarn (2) is woven into the back side at the position of crossing with the weft yarn (5) and is woven to be exposed on the front side at the positions of crossing with the remaining wefts (1)-(4) and (6)-(7). The warp yarn (3) is woven into the back side at the position of crossing with the weft yarn (2) and is woven to be exposed on the front side at the positions of crossing with the remaining wefts (1) and (3)-(7). The warp yarn (4) is woven into the back side at the position of crossing with the weft yarn (6) and is woven to be exposed on the front side at the positions of crossing with the remaining wefts (1)-(5) and (7). The warp yarn (5) is woven into the back side at the position of crossing with the weft yarn (3) and is woven to be exposed on the front side at the positions of crossing with the remaining wefts (1)-(2) and (4)-(7). The warp yarn (6) is woven into the back side at the position of crossing with the weft yarn (7) and is woven to be exposed on the front side at the positions of crossing with the remaining wefts (1)-(6). The warp yarn (7) is woven into the back side at the position of crossing with the weft yarn (4) and is woven to be exposed on the front side at the positions of crossing with the remaining wefts (1)-(3) and (5)-(7). The warp yarn (8) is woven into the back side at the position of crossing with the weft yarn (1) and is woven to be exposed on the front side at the positions of crossing with the remaining wefts (2)-(7). In this embodiment, as a result of the weave configuration as described above, the unevenness of the print-receiving surface 153A of the cloth tape 153 can be made relatively small.

<Weaving Density of Warp/Weft>

As a result of extensive studies conducted at the same time, the present inventors found out that, by making the weaving density of the warp relatively higher (e.g. to 300 [yarns/inch] or more) in the above described print-receiving surface 153A, the number of the warp yarns can be increased to reliably increase the exposure. Particularly, it was found out that, by using a six-or-more-harness satin in the above described satin weave, (the intersection points between the warp and the weft are reduced) the weaving density of the warp can reliably be increased. In the region of the print-receiving surface 153A shown in FIGS. 6A and 6B, as shown in FIG. 6C, such an increase in exposure of the warp can allow a large number of ink droplets (including a transfer layer 155A composed of an undercoat layer 155*b*, an ink layer 155*c*, and an overcoat layer 155*d* described later) I1-I13 from the ink ribbon IB to extensively adhere to a multiplicity of exposed positions. It is noted that, at the time of manufacturing of a cloth medium like the above described cloth tape 153 using a weaving machine, generally, the weaving machine must finely divide and move the warp upward and downward in accordance with the harnesses number of the satin. Also in this regard, as a result of uniquely conducted studies, the present inventors found out that the cloth tape 153 can be formed as a ten-or-less-harness satin so as to restrain the weaving from becoming too complicated and to enable reliable manufacturing by the weaving machine.

Although an excessively increased warp weaving density may make the warp too thin and result in a reduction in durability or cause misalignment in the satin weave, the present inventors found out as a result of uniquely conducted studies that, by setting the weaving density of the warp to, for example, 540 [yarns/inch] or less, the above described negative effects can be prevented. In the cloth tape 153 of this embodiment, the range of the weaving density of the weft is set to 80 [yarns/inch] or more and 540 [yarns/inch] or less for smooth weaving in conformity with the range of the weaving density of the warp described above from 300 [yarns/inch] or more to 540 [yarns/inch] or less.

<Low Print Quality in Comparison Example>

To confirm the study results described above, the present inventors fabricated the cloth tape 153 with a satin weave of five-harness satin as a comparison example. In this example, the weaving density of the warp was less than 300 [yarns/inch] and the weaving density of the weft was less than 80 [yarns/inch]. In the tape printer 1 having the above described configuration, so-called high-speed print was performed at the print speed of 100 [mm/sec] on the cloth tape 153 of this comparison example to fabricate the printed cloth tape 153'. The print formation result is shown in FIG. 7A. FIG. 7A shows the print formation of a capital letter "O" in this example and, because the harnesses number of the satin was small and the weaving density of the warp was low as described above, the exposure of the warp was less increased. Therefore, the unevenness on the print-receiving surface 153A' became relatively large and consequently caused a large number of blurred portions in the letter "O," resulting in a low print quality.

<High Print Quality from Manufacturing Conditions Conforming to Study Results>

Correspondingly to the above described comparison example, the present inventors fabricated the above described cloth tape 153 with a satin weave of six-or-more to ten-or-less harness satin (e.g., seven-harness satin) in conformity to the above described study results. In this case, the weaving density of the warp was 300 [yarns/inch] or more and 540 [yarns/inch] or less (e.g., 360 [yarns/inch]) and the weaving density of the weft was 80 [yarns/inch] or more and 540 [yarns/inch] or less (e.g., 106 [yarns/inch]). In the tape printer 1 having the above described configuration, as is the case with the above described comparison example, the high-speed print was performed at the print speed of 100 [mm/sec] on the cloth tape 153 to fabricate the printed cloth tape 153'. The print formation result is shown in FIG. 7B. As shown in FIG. 7B, because the harnesses number of the satin was larger than the above described comparison example and the weaving density of the warp was higher in this example, the exposure of the warp was sufficiently increased. Therefore, the unevenness on the print-receiving surface 153N became relatively small, resulting in a high print quality with an extremely small number of blurred portions in the letter "O."

<Calendering>

Additionally, known calendering is applied to the above described cloth tape 153 of this embodiment on the print-receiving surface 153A side for the purpose of the above described print quality improvement. The details will hereinafter be described with reference to FIG. 8.

A conceptual configuration of manufacturing equipment of the above described cloth tape 153 is shown in FIG. 8. In the manufacturing equipment 200 shown in FIG. 8, a raw fabric 153-0 before the calendering is wound around a supply roll 201. In this embodiment, the warp and the weft included in the raw fabric 153-0 are both made of polyester, for example. The raw fabric 153-0 fed out from the supply roll 201 is introduced into a calendering apparatus 210 via guide rolls 202, 203.

The calendering apparatus 210 in this example comprises heatable rotating drums 211, 211, rotating drums 212, 212, and rotating drums 213, 213. The introduced above described raw fabric 53-0 is fed at a predetermined speed and heated and pressed by the pairs of the rotating drums 211, 212, 213. As a result, the above-described raw fabric 53-0 is turned into a glossy fabric 153-1 having at least a side defined as the print-receiving surface 153A (both sides in this example) smoothed and given a gloss (see an enlarged view). This calendering is performed under the conditions of a heating temperature of 160 [° C. ] or more, the speed of above described feeding of 10 [m/min] or less, a pressure of 7 (MPa) or more during above described pressing, for example.

The glossy fabric 153-1 led out from the calendering apparatus 210 is supplied via a guide roll 204 to a heat cutting apparatus 220. The heat cutting apparatus 220 comprises respective heatable cutter parts 221, 221 on both sides in the width direction of the transport path of the glossy fabric 153-1. In this embodiment, the raw fabric 153-0 (i.e., the glossy fabric 153-1) is made of heat-meltable fiber, and both end portions in the width direction of the glossy fabric 153-1 are cut (=heat-cut) by the above described cutter parts 221, 221 to form the above described cloth tape 153. The heating condition of the above described cutter part 221 is 525° C., for example. As a result of this process, the print-receiving surface 153A of the cloth tape 153 comprises ear parts 153*a*, 153*a* located at the edge portions on both sides in the width direction and having a relatively greater thickness, and a print area part 153*b* located in an intermediate portion in the width direction between the ear parts 153*a*, 153*a* for print formation by the printing head 11 described above. For simplicity of illustration, the ear parts 153*a* are not shown in the figures other than FIG. 8.

The cloth tape 153 formed in this way is wound into an original wound roll 206 via a guide roll 205. As a result of the process described above, the cloth tape 153 has the above described warp with a thickness of 30 [denier] or more and 90 [denier] or less (e.g., specifically, 48 [denier]) and the weft with a thickness of 30 [denier] or more and 90 [denier] or less (e.g., specifically, 75 [denier]). For the above described first roll R1, the above described original wound roll 206 may directly be used, or the cloth tape 153 fed out again from the original winding roll 206 may be wound around an appropriate winding core (such that the print-receiving surface 153 A is on the outer peripheral side).

<Ink Ribbon>

On the other hand, in a print using the heat transfer printing of ink as in the case of the above described ink ribbon IK, ink droplets melted by heat reception adhere to a transfer target to form a print. For the print quality improvement, melting and transferring are preferably speeded up by lowering a melting point at which the ink ribbon melts; however, if the melting point is made too low, the durability of the ink ribbon may degrade during transportation under a high-temperature condition, for example. Therefore, to achieve both the print quality improvement and the suppression of durability degradation at the same time, some measures must be taken with respect to the layer structure of the ink ribbon, the physical properties of the layers, etc.

<Details of Laminated Structure of Ink Ribbon>

As a result of uniquely conducted studies, the present inventors found out that both the above described print quality improvement and the durability degradation can be achieved at the same time by setting a melting point of a layer adhering to the cloth tape 153 to a predetermined range (described later) in a laminated structure of the ink ribbon IB. FIG. 9A shows a conceptual diagram of details of the laminated structure of the ink ribbon IB in this embodiment.

As shown in FIG. 9 A, the ink ribbon IB in this example has a five-layer laminated structure comprising: a ribbon base material layer 155*a* made of a PET film etc. as a ribbon base layer; an undercoat layer 155*b* provided adjacently on one side (lower side of FIG. 9A) in a thickness direction of the ribbon base layer 155*a* and melted by predetermined heat reception to separate from the ribbon base layer 155*a;* an ink layer 155*c* provided adjacently on one side in the above described thickness direction of the undercoat layer 155*b* (i.e., positioned between an overcoat layer 155*d* described later and the undercoat layer 155*b* in the thickness direction) and containing, for example, a pigment to give a visual color as a print; the overcoat layer 155*d* provided adjacently on one side in the thickness direction of the ink layer 155*c* and adhering to the transfer target; and a back coat layer 155*e* provided adjacently on the other side (the upper side of FIG. 9A) in the thickness direction of the ribbon base layer 155*a* and playing a role as a heat-resistant coat.

For example, the ribbon base layer 155*a* may be made of, for example, a polyester film such as a polyethylene naphthalate film (PEN), a polyarylate film (PAR), and a polybutylene terephthalate film (PBT) other than the above described polyethylene terephthalate film (PET), or other various types of films generally used as base films of ink ribbons.

The undercoat layer 155*b* and the overcoat layer 155*d* contain a resin component and a wax component, and the ink layer 155*c* contains a resin component, a pigment component, and a wax component (described later in detail).

In the ink ribbon IB having the above described configuration, the above described undercoat layer 155*b* melts due to reception of heat from the printing head 11, so that a transfer layer 155A composed of the undercoat layer 155*b*, the ink layer 155*c*, and the overcoat layer 155*d* is separated from the above described ribbon base layer 155*a*. The overcoat layer 155*d* side of the transfer layer 155A is transferred and thereby adheres to the print-receiving surface 153A of the cloth tape 153 that is the transfer target (see FIG. 9B). As a result, the print formation onto the print-receiving surface 153A of the cloth tape 153 by the ink ribbon IB is performed, and the above described printed cloth tape 153' is generated.

<Setting of Melting Point>

As a result of extensive studies, the present inventors found out that both the above described print quality improvement and the durability degradation can be achieved at the same time by setting the melting point of the above described overcoat layer 155*d* to 60° C. or more and 90° C. or less. In particular, by lowering the melting point of the overcoat layer 155*d* to a relatively low temperature of 90° C. or less, the overcoat layer 155*d* melts and separates from the ribbon base layer 155*a* even though the received heat is not so high, and quickly adheres to the cloth tape 153 that is the transfer target. As a result, the print quality can be improved. Particularly, as described above, when a high-speed print is performed at, for example, 100 [mm/sec] or more, the above described print quality improvement effect is remarkable. On the other hand, if the melting point is made too low, the durability of the whole ink ribbon IB may degrade during transportation under a high-temperature condition, etc. In this embodiment, by setting the melting point of the overcoat layer 155*d* to 60° C. or higher, the above described durability degradation at a high temperature can be suppressed. As a result of the above, both the print quality improvement and the suppression of durability degradation can be achieved at the same time.

<Low Print Quality in Comparison Example>

To confirm the study results described above, the present inventors performed a so-called high-speed print at the print speed of 100 [mm/sec] on the above described cloth tape 153 with the tape printer 1 having the above described configuration by using the ink ribbon IB having the melting point of the above described overcoat layer 155*d* set to higher than 90° C. to fabricate the printed cloth tape 153' as a comparison example. The print formation result is shown in FIG. 10A. FIG. 10A shows the print formation of a capital letter "O" in this example and, because the melting point of the overcoat layer 155*d* was high as described above, adhesion due to melting and transferring was not so quickly performed (the melting/transfer speed was not sufficiently fast with respect to the feeding speed, and the adhesion was not performed in time). Therefore, a large number of blurred portions are generated in the letter "O" on the print-receiving surface 153A', resulting in a low print quality.

<High Print Quality from Manufacturing Conditions Conforming to Study Results>

Correspondingly to the above described comparison example, the present inventors performed the high-speed print at the print speed of 100 [mm/sec] as is the case with the above described comparison example on the above described cloth tape 153 with the tape printer 1 having the above described configuration by using the ink ribbon IB comprising the overcoat layer 155*d* having a melting point of 60° C. or more and 90° C. or less (e.g., 80° C.) in conformity to the above described study results to fabricate the printed cloth tape 153'. The print formation result is shown in FIG. 10A. As shown in FIG. 10B, in this example, because the melting point of the overcoat layer 155*d* was lower than the above described comparison example, adhesion due to melting and transferring was quickly performed (the melting/transfer speed was sufficiently fast with respect to the feeding speed). Therefore, a high print quality was achieved with an extremely small number of blurred portions in the letter "O" on the print-receiving surface 153A'.

In the ink ribbon IB having the above described configuration, in this embodiment, the ratio (weight ratio) of the resin component and the wax component in the overcoat layer 155*d* is resin:wax=5:5, for example. The ratio (weight ratio) of the resin component and the wax component in the undercoat layer 155*b* is resin:wax=1:9, for example and, as a result, the melting point of the whole undercoat layer 155*b* is approx. 95° C., for example. The ratio (weight ratio) of the resin component, the pigment component, and the wax component in the ink layer 155*c* is resin:pigment:wax=4:5:1, for example, and as a result, the melting point of the whole ink layer 155*c* is approx. 85° C., for example. As a result of further studies on the overcoat layer 155*d* in terms of the weight ratio of the wax component, the present inventors found out that the adhesion to the transfer target can reliably be improved by setting the weight ratio of the wax component to 50 [%] or more. It was also found out that a degradation in abrasion resistant can be suppressed by setting the weight ratio of the wax component to 70 [%] or less.

The above described wax components used in the above described undercoat layer 155*b*, the overcoat layer 155*d*, and the ink layer 155*c* may be, for example, one (or a mixture of two or more) of the following: natural waxes such as beeswax (animal wax), carnauba wax, candelilla wax, Japan wax, rice wax (vegetable wax), montan wax, ozokerite wax, and cesarene wax (mineral wax), petroleum waxes such as paraffin wax and microcrystalline wax, synthetic waxes such as Fischer-Tropsch wax, polyethylene wax (hydrocarbon synthetic wax), higher fatty acid esters, fatty acid amides, ketones, amines, and hydrogen hardened oil.

The above described resin (heat-meltable resin) components used in the above described undercoat layer 155*b*, the overcoat layer 155*d*, and the ink layer 155*c* may be, for example, one (or a mixture of two or more) of the following: olefin-based copolymer resins such as an ethylene-vinyl acetate copolymer and an ethylene-acrylic ester copolymer, a polyamide resin, a polyester resin, an epoxy resin, a polyurethane resin, an acrylic resin, a vinyl chloride resin, a cellulose resin, a vinyl alcohol resin, a petroleum resin, a phenol resin, a styrene resin, a vinyl acetate resin, elastomers such as natural rubber, styrene-butadiene rubber, isoprene rubber, and chloroprene rubber, polyisobutylene, and polybutene.

<Advantages of This Embodiment>

As described above, in this embodiment, the unevenness on the print-receiving surface 153A can be reduced by forming the cloth tape 153 with a satin weave increasing the warp exposed on the surface and by using the surface on the side with the increased warp exposure as the print-receiving surface 153A. Particularly, by setting the weaving density of the warp to 300 [yarns/inch] or more, the number of warp yarns can be increased to reliably increase the exposure. Particularly, by using a six-or-more-harness satin, the intersection points of the warp and the weft can be reduced to reliably increase the weaving density of the warp. Additionally, the calendering can be applied to the above described print-receiving surface 153A to give a gloss to the surface of print-receiving surface 153A. As a result, the print-receiving surface 153 A having less unevenness and more warp exposure along with the gloss can be achieved and, therefore, the print quality can be improved when a print is formed by transfer of ink droplets (the above described transfer layer 155A in the example) using the above described ink ribbon IB. Particularly when the high-speed print of, for example, 100 [mm/sec] or more is performed, the quality improvement effect is large.

Particularly in this embodiment, by setting the thickness of the warp to 30 [denier] or more in the cloth tape 153, the warp can reliably be restrained from becoming too thin and resulting in a reduction in durability or causing misalignment in the satin weave. By setting the thickness of the warp to 90 [denier] or less, a print quality can reliably be restrained from degrading due to a reduction in weaving density leading to loosening of the weave. By setting the thickness of the weft to 30 [denier] or more and 90 [denier] or less in accordance with the thickness range of the warp, the cloth tape 153 can be acquired in proper combination with the warp capable of providing the effect described above.

Particularly in this embodiment, the heat cutting is performed on both sides in the width direction of the cloth tape 153. As a result, the occurrence of fray at edge portions on both sides can be suppressed.

Particularly in this embodiment, as described above, the print quality effect can remarkably be acquired especially at the time of high-speed printing at a print speed of 100 [mm/sec] or more. In this case, by suppressing the upper limit of the print speed to 200 [mm/sec] or less, good meltability and good adhesiveness to the transfer target of the ink droplets of the ink ribbon IB (the above described transfer layer 155A in this example) can be ensured to reliably improve the print quality.

Although the weaving density of the warp is set to 300 [yarns/inch] or more from the viewpoint of increasing the exposure of the warp and reducing the unevenness in the above description, the weaving density may be determined with consideration also given to the resolution of the printing head 11 (the cloth tape 153 having a weaving density equal to or greater than the resolution of the printing head 11 may be used). In particular, for example, if the resolution of the printing head 11 is relatively high (e.g., 300 dpi) and the value of the weaving density of the cloth tape 153 is smaller than the resolution (=less than 300 [yarns/inch]. e.g., about 200 [yarns/inch]), ink droplets generated at fine resolution are prevented from adhering because of the unevenness due to the coarse weaving density and may not be able to adhere and form dots. Therefore, for example, if the resolution of the printing head 11 is about 300 dpi as described above, the weaving density of the cloth tape 153 may be set to a value at least equal to or greater than the resolution, i.e., 300 [yams/inch] or more, or preferably to a value increased by about 20%, i.e., about 360 [yarns/inch]. As a result, the high print quality can reliably be acquired.

As described above, in this embodiment, by setting the melting point of the overcoat layer 155*d* included in the ink ribbon IB to 60° C. or more and 90° C. or less, both the print quality improvement and the suppression of durability degradation can be achieved at the same time.

Particularly in this embodiment, by setting the weight ratio of the wax component contained in the overcoat layer 155*d* of the ink ribbon IB to 50 [%] or more and 70 [%] or less (50% in the example described above), the soundness of the ink ribbon can reliably be maintained by suppressing a degradation in abrasion resistant while reliably improving the adhesion to the transfer target Particularly in this embodiment, the cloth tape 153 has the ear parts 153 subjected to the heat cutting on both sides in the width direction, and the occurrence of fray can be suppressed at the edge portions on both sides. Since a print formation is performed on the printing area part 153*b* with a small thickness while avoiding a print formation on the ear parts 153*a* with a large thickness, the occurrence of print blurring etc. can reliably be suppressed.

The present disclosure is not limited to the above described form and can variously be modified without departing from the spirit and the technical ideas thereof. Various modification examples satisfying such a condition will hereinafter be described in order. It is noted that the parts equivalent to those of the embodiment are denoted by the same reference numerals and will not be described or will be described in a simplified manner as needed.

(1) When Ink Layer of Ink Ribbon Additionally Has Adhesive Function

FIG. 11A is a conceptual diagram of details of a laminated structure of the ink ribbon IB in this modified example. As shown in FIG. 11A, in this modified example, instead of the ink layer 155*c* and the overcoat layer 155*d* in the laminated structure shown in FIG. 9A of the above described embodiment, a four-layer laminated structure is provided with an ink layer 155*c*' with an adhesive function having both characteristics of the two layers. This ink layer 155*c*' contains a pigment giving a visual color as a print and also has a function of adhering to the transfer target. As is the case with the above described ink layer 155*c*, the ink layer 155*c*' contains a resin component, a pigment component, and a wax component.

In the ink ribbon IB having the above described configuration, the above described undercoat layer 155*b* melts due to reception of heat from the printing head 11, so that the transfer layer 155A of this modification example composed of the undercoat layer 155*b* and the ink layer 155*c*' is separated from the above described ribbon base layer 155*a*. The transfer layer 155A is transferred and thereby adheres to the print-receiving surface 153A of the cloth tape 153 that is the transfer target (see FIG. 11B). As a result, the print formation onto the print-receiving surface 153A of the cloth tape 153 by the ink ribbon IB is performed, and the above described printed cloth tape 153' in this modification example is generated.

The present inventors found out that, in the configuration of this modification example, as is the case with the overcoat layer 155*d* of the above described embodiment, both the above described print quality improvement and the durability degradation can be achieved at the same time by setting the melting point of the whole ink layer 155*c*' to 60° C. or more and 90° C. or less (e.g., 80° C. in this modification example). Particularly, as is the case with the above described embodiment, when a high-speed print is performed at, for example, 100 [mm/sec] or more, the above described print quality improvement effect is remarkable.

As is the case with the above described embodiment, as a result of further studies on the weight ratio of the wax component contained in the ink layer 155*c*', the present inventors confirmed that, by setting the weight ratio of the wax component to 50 [%] or more and 70 [%] or less, the adhesion to the transfer target can reliably be improved while suppressing a degradation in abrasion resistant.

(2) Other

In the above description, the arrows shown in FIG. 5 indicate an example of signal flow and are not intended to limit the signal flow directions.

The techniques of the embodiment and modification examples may appropriately be utilized in combination other than those described above.

What is claimed is:

1. An elongated cloth medium to be recorded made with a satin weave that ranges from six-harness satin to ten-harness satin by using a warp made of heat-meltable fiber in a medium longitudinal direction and a weft made of heat-meltable fiber in a direction orthogonal to the medium longitudinal direction, the cloth medium comprising one surface and another surface, said warp having a weaving density in a range from 300 [yarns/inch] to 540 [yarns/inch], said weft having a weaving density in a range from 80 [yarns/inch] to 540 [yarns/inch], said one surface having said warp is more exposed than said weft in accordance with said satin weave, the cloth medium further comprising, on the one surface, a print-receiving surface on which calendering is executed by heating and pressing, said print-receiving surface being configured such that printing is performed by heat transfer of ink from an ink ribbon receiving heat from a thermal head, and the cloth medium further comprising two heat-cut parts that are cut by heating, one of the two heat-cut parts being disposed on a first edge portion of the medium in a medium width direction, and the other of the two heat-cut parts being disposed on a second edge portion of the medium in the medium width direction, wherein a roll of the cloth medium further comprises two flange parts that sandwich said heat-cut parts on both sides in the medium width direction.

2. The cloth medium according to claim 1, wherein:

said warp has a thickness that ranges from 30 [denier] to 90 [denier], and said weft has a thickness that ranges from 30 [denier] to 90 [denier].

3. An elongated recorded cloth medium made with a satin weave that ranges from six-harness satin to ten-harness satin by using a warp made of heat-meltable fiber in a medium longitudinal direction and a weft made of heat-meltable fiber in a direction orthogonal to the medium longitudinal direction, the recorded cloth medium comprising:

one surface and another surface, said one surface having said warp being more exposed than said weft in accordance with said satin weave; and a print-receiving surface that is disposed on the one surface and that calendering is executed by heating and pressing; and said warp having a weaving density in a range from 300 [yarns/inch] to 540 [yarns/inch], and said weft having a weaving density in a range from 80 [yarns/inch] to 540 [yarns/inch], printing being performed on said print-receiving surface by heat transfer of ink from an ink ribbon receiving heat from a thermal head, the cloth medium further comprising two heat-cut parts that are cut by heating, one of the two heat-cut parts being disposed on a first edge portion of the medium in a medium width direction, and the other of the two heat-cut parts being disposed on a second edge portion of the medium in the medium width direction, wherein a roll of the cloth medium further comprises two flange parts that sandwich said heat-cut parts on both sides in the medium width direction.

4. The recorded cloth medium according to claim 3, further comprising a part to be recorded disposed between said two heat-cut parts and includes a desired record formed.

5. A cloth medium cartridge comprising:

a roll of a cloth medium to be recorded that includes an outer periphery portion around which an elongated cloth medium for recording is wound; and a supporting member that rotatably supports said roll, said cloth medium being made with a satin weave that ranges from six-harness satin to ten-harness satin by using a warp in a medium longitudinal direction and a weft in a direction orthogonal to the medium longitudinal direction and comprising:

one surface;

another surface; and two heat-cut parts that are cut by heating, said warp having a weaving density in a range from 300 [yarns/inch] to 540 [yarns/inch], said weft having a weaving density in a range from 80 [yarns/inch] to 540 [yarns/inch], said one surface having said warp more exposed than said weft in accordance with said satin weave, the cloth medium further comprising on the one surface a print-receiving surface that calendering is executed, and the roll of the cloth medium to be recorded being wound such that said print-receiving surface is disposed on an outer peripheral side and said two heat-cut parts are respectively disposed on edge portions on the sides of the medium in a medium width direction.

6. The cloth medium cartridge according to claim 5, wherein said print-receiving surface is configured such that printing is performed by transfer of ink from an ink ribbon receiving heat from a thermal head.

7. The cloth medium cartridge according to claim 5, wherein the roll of the cloth medium further comprises two flange parts that sandwich said two heat-cuts parts on both sides in the medium width direction.

* * * * *